US007712148B2

(12) United States Patent
Carlson

(10) Patent No.: US 7,712,148 B2
(45) Date of Patent: May 11, 2010

(54) ARTICULATED BODY ARMOR/DUTY GEAR SUPPORT VEST

(75) Inventor: Richard A. Carlson, Chino Hills, CA (US)

(73) Assignee: Safariland, LLC, Jacksonville, FL (US)

( * ) Notice: Subject to any disclaimer, the term of this patent is extended or adjusted under 35 U.S.C. 154(b) by 614 days.

(21) Appl. No.: 11/245,901

(22) Filed: Oct. 7, 2005

(65) Prior Publication Data

US 2007/0079415 A1 Apr. 12, 2007

(51) Int. Cl.
*F41H 1/02* (2006.01)
*F41H 13/00* (2006.01)

(52) U.S. Cl. ..... 2/2.5; 2/102

(58) Field of Classification Search ..... 2/2.5
See application file for complete search history.

(56) References Cited

U.S. PATENT DOCUMENTS 4,302,847 A * 12/1981 Miles ..... 2/465
4,425,667 A * 1/1984 Harrison ..... 2/462
4,475,247 A * 10/1984 Lee ..... 2/2.5
4,497,069 A * 2/1985 Braunhut ..... 2/2.5
4,507,802 A * 4/1985 Small ..... 2/2.5
4,601,067 A * 7/1986 Buonassissi ..... 2/102
4,602,385 A * 7/1986 Warren ..... 2/2.14
4,645,103 A * 2/1987 Bianchi et al. ..... 224/243
5,073,985 A * 12/1991 Stone et al. ..... 2/2.5
5,325,538 A * 7/1994 Schoenweiss et al. ..... 2/2.5
5,327,811 A * 7/1994 Price et al. ..... 89/36.05
5,331,683 A * 7/1994 Stone et al. ..... 2/2.5
5,398,340 A * 3/1995 Kibbee ..... 2/2.5
5,431,318 A * 7/1995 Garcia ..... 224/192
5,465,429 A * 11/1995 Rogers et al. ..... 2/300
5,488,738 A * 2/1996 Seamans ..... 2/69
5,495,621 A * 3/1996 Kibbee ..... 2/2.5
5,549,495 A * 8/1996 Burnworth et al. ..... 441/108
5,644,792 A * 7/1997 Tishler et al. ..... 2/2.5
5,754,982 A * 5/1998 Gainer ..... 2/2.5
5,797,140 A * 8/1998 Davis et al. ..... 2/2.5
5,829,653 A * 11/1998 Kaiser ..... 224/577
5,943,694 A * 8/1999 Moureaux et al. ..... 2/2.5
5,966,747 A * 10/1999 Crupi et al. ..... 2/466
5,974,585 A * 11/1999 Bachner, Jr. ..... 2/2.5
5,991,925 A * 11/1999 Wu ..... 2/102

(Continued)

FOREIGN PATENT DOCUMENTS

WO WO 00/48480 8/2000

OTHER PUBLICATIONS

Communication from the European Patent Office dated Jun. 5, 2007 with European Search Report, completed on May 25, 2007, The Hague (10 pages).

*Primary Examiner*—Bobby H Muromoto, Jr.
(74) *Attorney, Agent, or Firm*—Christie, Parker & Hale, LLP

(57) ABSTRACT

A ballistic vest having an articulated body armor component and duty gear support component connected together such that the body armor and duty gear support component each support the weight of duty gear items positioned on a duty gear belt. The body armor component includes a rear panel fastened to the duty gear support component and a front panel attached to the duty gear component such that the front component can articulate over the duty gear portion based upon movement of a wearer.

18 Claims, 3 Drawing Sheets

U.S. PATENT DOCUMENTS 6,088,831 A * 7/2000 Jensen et al. ..... 2/2.5
6,182,288 B1 * 2/2001 Kibbee ..... 2/2.5
6,185,738 B1 * 2/2001 Sidebottom ..... 2/2.5
6,185,742 B1 * 2/2001 Doherty ..... 2/81
6,233,737 B1 * 5/2001 Ditchfield et al. ..... 2/2.5
6,266,818 B1 * 7/2001 Howland et al. ..... 2/2.5
D452,047 S * 12/2001 Ditchfield et al. ..... D29/100
6,543,055 B2 * 4/2003 Howland et al. ..... 2/2.5
6,681,400 B1 * 1/2004 Mills ..... 2/2.5
6,892,392 B2 * 5/2005 Crye et al. ..... 2/2.5
6,961,957 B2 * 11/2005 Carlson ..... 2/2.5
6,981,624 B2 * 1/2006 Link et al. ..... 224/674
7,020,897 B2 * 4/2006 Johnson ..... 2/102
7,047,570 B2 * 5/2006 Johnson ..... 2/102

* cited by examiner

ARTICULATED BODY ARMOR/DUTY GEAR SUPPORT VEST

FIELD OF THE INVENTION

This invention relates to protective vests, and more particularly, to articulated body armor commonly known as a ballistic vest, which incorporates a duty gear belt system attachable to the ballistic vest.

BACKGROUND OF THE INVENTION

Ballistic vests have been in use for many years and have saved the lives of military personnel and law enforcement officers. As a result, the military and law enforcement agencies have made it mandatory for soldiers and officers to wear a ballistic vest while on duty.

Ballistic vests have been available in recent years as a protective panel having overlying layers of a fabric made from woven high tensile strength fibers. Woven fabrics from an aramid fiber known as Kevlar, for example, have been used successfully in ballistic vests because of the high energy absorption properties of the fabric material. The material is also reasonably light in weight and flexible, which provides improved comfort when compared with previous vests which were made of metal and were therefore heavier and more rigid. The comfort of a ballistic vest is extremely important, especially to soldiers and law enforcement officers, because of the heat build-up that occurs from wearing a heavy and inflexible vest for the long hours in use. Resistance to projectile penetration is a principle factor in designing a ballistic vest; and added protective layers can offer greater protection against projectiles having the higher threat levels, but added protective layers also add undesired weight and inflexibility of the vest.

In addition to woven Kevlar fabric layers, ballistic vests have been made from other high strength fibers and composites to reduce weight and improve flexibility of the vest. However, ballistic vests using the lighter, more flexible materials also must offer the required minimum levels of protection against penetration by different types of projectiles. The more flexible the ballistic fabrics are, the more bunching and backface deformation occurs upon impact from a projectile. A vest must not be too flexible where it cannot protect the wearer.

Concealable ballistic vests are body armor worn by law enforcement personnel close to the body under the uniform. Concealable ballistic vests are worn continuously for the entire time the officer is on duty. These vests, for comfort reasons, are designed to be shorter in the front panel so that they do not bunch or bind when an officer is in a seated position. Consequently, this design exposes vital areas of the lower abdomen to ballistic threats when the officer is standing. Additionally, the front panel of the ballistic vest is designed shorter to not bind with a duty gear belt worn by the officer. Currently available vests provide no protection for the officer on the region of the body occupied by the duty gear belt. In addition, duty gear belts must carry an average of 8 to 10 and sometimes up to 15 pounds of equipment, ranging from flashlights, keys and handcuffs, OC spray, batons and duty weapons such as guns, holsters and ammunition. All of the weight from the duty gear in addition to the ballistic vest can become a health hazard for the officer in the form of fatigue, pinched nerves, sore muscles and bruises.

Consequently, a need exists for an improved vest design which addresses the drawbacks of previous vest designs, namely, to provide a combination body armor/duty gear support system which provides increased protection for the sides and lower abdomen of the wearer, reduces heat build-up, and distributes duty gear weight across the torso.

SUMMARY OF THE INVENTION

The present invention provides a combination articulated body armor and duty gear support ballistic vest. The ballistic vest preferably comprises a plurality of overlying first flexible layers arranged in a stack on a strike side of the vest, and a plurality of overlying second flexible layers arranged in a stack on a body side of the vest. Preferably, each first flexible layer comprises a thin, flexible, woven fabric layer made of high tensile strength polymeric fibers. The individual woven fabric layers form a soft, flexible woven fabric first panel for the vest. Preferably, each second flexible layer comprises a thin, flexible imperforate fiber-reinforced plastic sheet comprising an array of plastic fibers embedded in a thermoplastic resinous matrix that forms each film sheet. The second layers overlie each other and as a combination are referred to as a second panel of the vest. The first and second panels are both located in the front and rear of the vest and around the waist in the duty gear region of the vest. Although this is a preferred ballistics package, any type and number of ballistic packages which meet any threat level are contemplated for use in the present invention. The vest of the present invention preferably is worn on the outside of the wearers' underclothing as a uniform and is commonly referred to as body armor.

The ballistic vest of the present invention incorporates two basic components which are the vest component and the duty gear component. The ballistic vest incorporates fasteners to fasten the vest and duty gear components together, such as hook and loop fasteners, buckles, zippers and other fastening systems.

The duty gear component provides ballistic protection to the sides and lower abdomen of the wearer and is positioned around the waist traditionally occupied by a duty gear belt. The duty gear component includes loops positioned on its outer surface through which the duty gear belt is inserted and attached to the duty gear component. Optionally, the duty gear component can integrate the duty gear belt onto its outer surface. The vest component of the ballistic vest provides protection for the front and back of the upper torso and is fastened to the duty gear portion along the lower edge of a back panel of the vest. A front panel of the vest component can be made longer to articulate over the duty gear component offering comfort when seated yet expands to cover the lower abdomen when the officer is standing. The front panel has buckles, or other fastening means along its lower surface for attaching to mating buckles on the duty gear portion.

The vest component includes an outer carrier which is constructed to look like a police uniform shirt to aid in public identification of the officers and eliminates the need for an additional uniform shirt which results in a cooler ballistics system permitting improved airflow about the body. The vest component has an opening between the front and back panels for placement of the vest over the wearer's head.

Consequently, the ballistic vest of the present invention provides the benefits of a combined articulated body armor and duty gear support vest which provides additional ballistics protection and a support system for an officer's duty gear. The vest can support the weight of the duty gear, instead of just by a traditional belt, which eliminates health problems. The ballistic vest, having an integrated duty gear component, covers a larger area of the wearer previously exposed while standing, and since the vest is articulated it retracts when seated because the duty gear component slides underneath the vest component. The front panel of the ballistic vest folds over the duty gear component in the seated position.

BRIEF DESCRIPTION OF THE DRAWINGS

These and other features and advantages of the present invention will be more fully understood by reference to the drawings and following detailed description wherein.

DETAILED DESCRIPTION OF THE INVENTION

Figure 1:
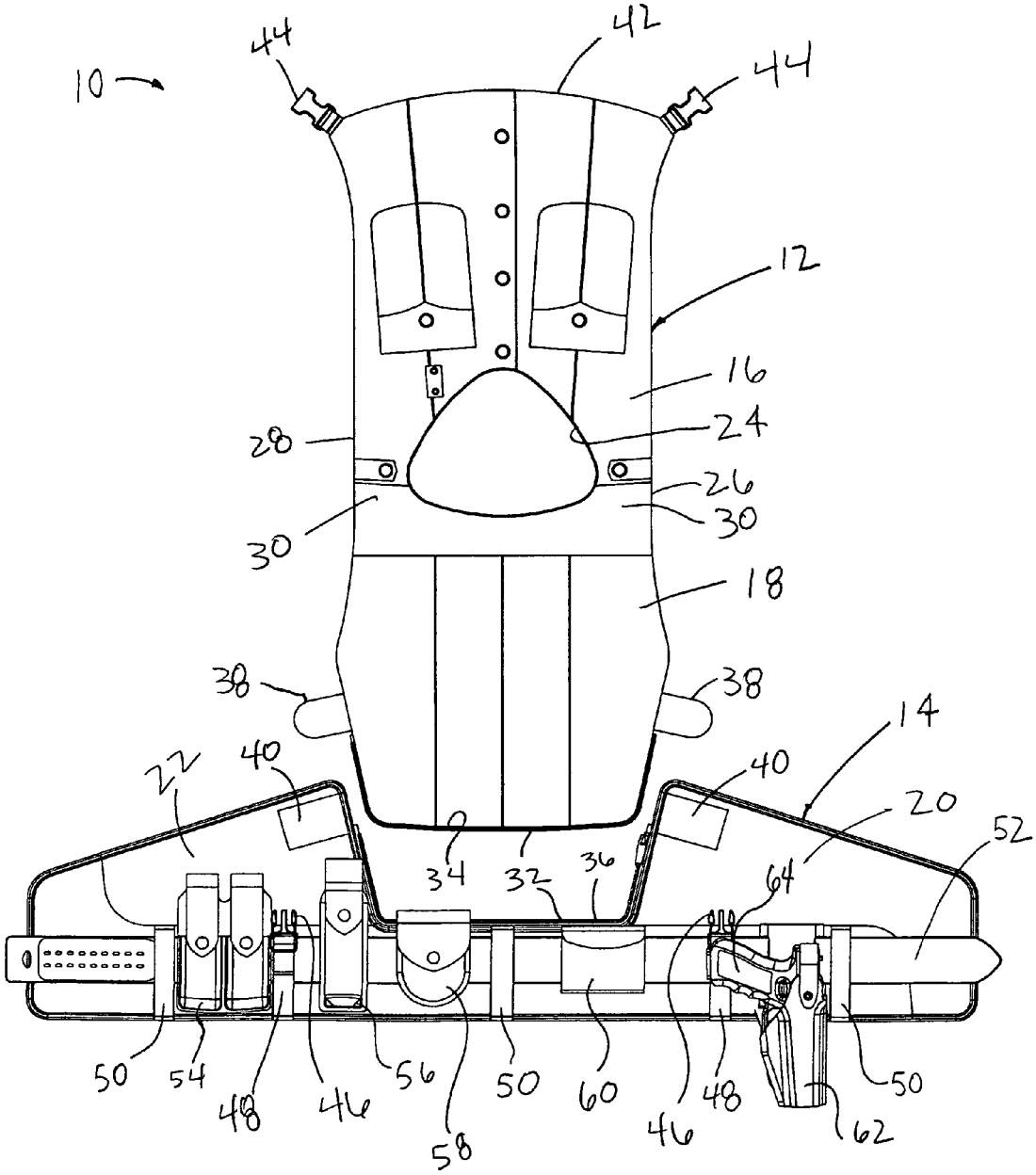
FIG. 1 is an exploded flat view of a ballistic vest of the present invention.
Figure 2:
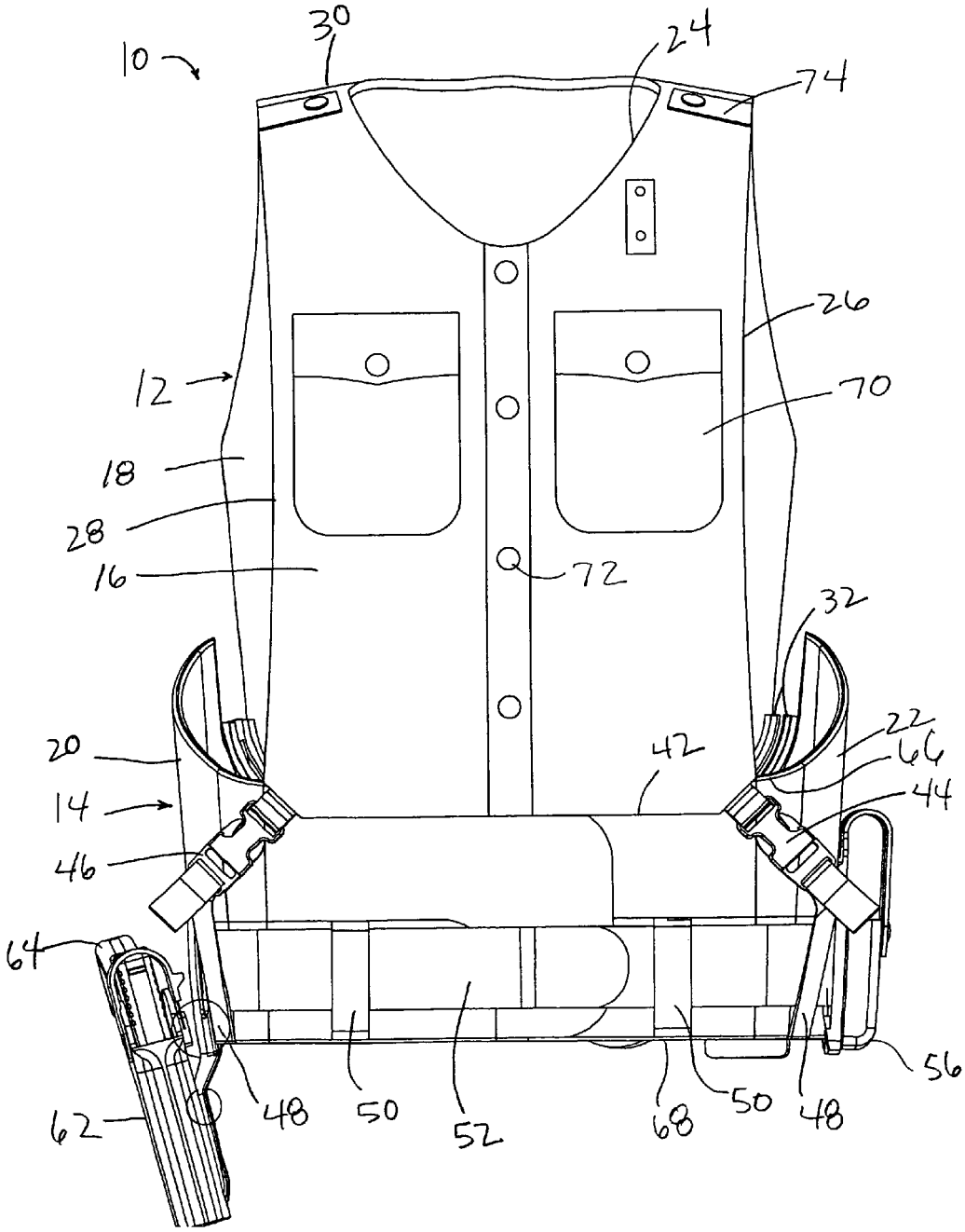
FIG. 2 is a front view of the ballistic vest of FIG. 1.
Figure 3:
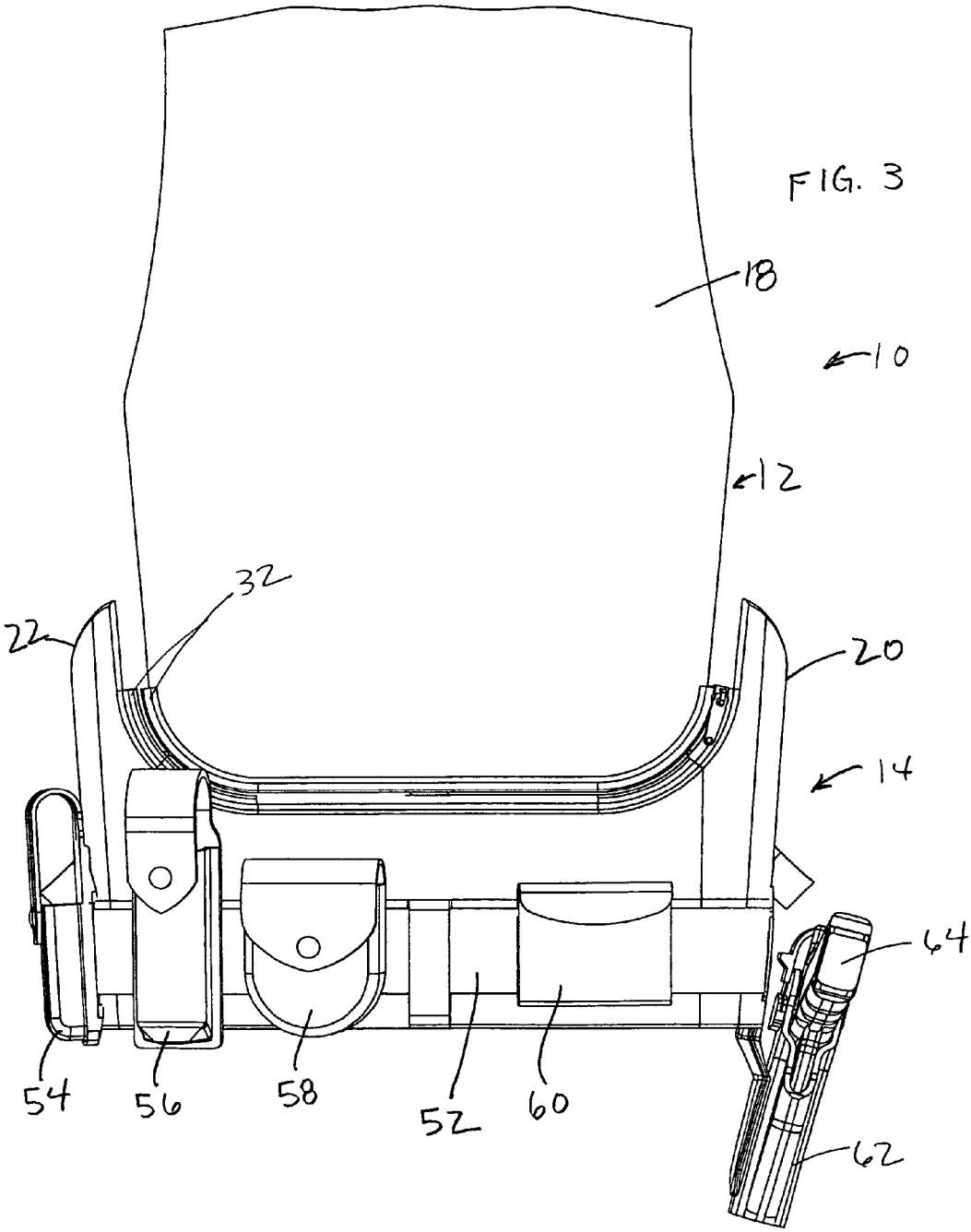
FIG. 3 is a back view of the ballistic vest of the present invention.

A ballistic vest system 10 of the present invention is shown in FIGS. 1, 2 and 3. The ballistic vest system 10 is also known as body armor which is worn by military and law enforcement officers and includes a vest component 12 and a duty gear component 14. The vest component 12 includes a front panel 16 and a rear panel 18. The front panel 16 protects the chest and stomach of the wearer while the rear panel 18 protects the back of the wearer. Contained within the front and rear panels is a ballistic package which comprises individual layers of ballistic material located within a covering layer as commonly known. The duty gear component 14 includes raised side portions 20 and 22 which protects the sides of the wearer when positioned around the waist of the wearer. The duty gear component also contains a ballistics package similar to the vest component.

The vest component includes an opening 24 for placement over the head of the wearer when the vest is put on which, along with side edges 26 and 28, define shoulder regions 30 of the vest component 12. The vest component 12 is attached to the duty gear component 14 by a number of fasteners including a zipper 32 positioned along a bottom edge 34 of the rear panel 18 and edge 36 of the duty gear component. Hook 38 and loop 40 fasteners also assist in attaching the rear panel to the duty gear component. Hook fastener 38 is positioned along side edges 26 and 28 of rear panel 18 and loop fastener 40 is positioned along an outer surface of the raised side portion 20 adjacent zipper 32. The front edge 42 of front panel 16 is attached to the duty gear component by buckles 44 positioned on either corner of front edge 42. Buckles 44 connect to mating buckles 46 located on an outer front surface of the duty gear component by elastic straps 48.

Duty gear component 14 has a series of belt loops 50 positioned along a lower portion of the duty gear component for receipt of a duty gear belt 52. Duty gear belt 52 contains typical duty gear items such as OC spray container 54, knife container 56, handcuff case 58, ammunition pouch 60 and holster 62 for revolver 64. Other types of duty gear items can be positioned on the belt such as flashlights, keys, batons, stun guns or other duty weapons. The weight of the duty gear belt and duty gear items is supported by the entire ballistic vest considering the vest component and duty gear components are attached together.

Although it is shown that the duty gear belt is attached to the duty gear component by belt loops, it is to be understood that the duty gear belt can be integrally formed with the duty gear component. The duty gear component is fastened around the waist of the wearer by the belt buckle attached to the duty gear belt.

The length of the front panel 16 can be made longer than conventional concealable ballistic vests so that front edge 42 extends down and slightly overlaps upper surface 66 of the duty gear component. In this manner, there is no lower torso areas exposed in the standing position of the wearer. In addition, when a wearer is in the seated position, the front edge 42 articulates over and extends down to the bottom edge 68 of the duty gear component.

The vest component 12 has an outer carrier which is designed to mimic a police uniform shirt including pockets 70, buttons 72, tabs 74, and the like, to aid in public identification of the officers with a more traditional uniform look. Similarly, the outer carrier of the vest of the present invention can be of a tactical variety which would contain loops and attachment mechanisms for additional tactical pouches and gear. Designing the vest to mimic a uniform provides for a cooler vest and more comfortable by eliminating additional uniform clothing. The unique ballistic vest of the present invention offers a system for support of heavy duty gear, increased ballistic protection, a cooler system permitting improved airflow about the body and easier donning and doffing of duty equipment. In addition, the vest and duty gear support combination is easy to put on and remove from the wearer's body.

Although the present invention has been shown and illustrated with respect to an embodiment thereof, the invention is not to be so limited since changes and modifications can be made therein which are within the scope of the invention as hereinafter claimed.

What is claimed is:

1. A ballistic vest comprising:

a ballistic vest component having a front panel and a rear panel; and a single piece ballistic duty gear component sized to encircle the waist of a wearer attached to the ballistic vest component such that the front panel of the vest component can articulate over the duty gear component based upon movement of the wearer;

wherein the ballistic duty gear component has a duty gear belt on an outer surface of the ballistic duty gear component for attachment of duty gear equipment.

2. The ballistic vest of claim 1 wherein the duty gear belt is integrally formed into the ballistic duty gear component.

3. The ballistic vest of claim 1 wherein the ballistic vest component and the ballistic duty gear component each contain a ballistic package.

4. The ballistic vest of claim 1 wherein the rear panel of the ballistic vest component is attached to the ballistic duty gear component by a fastener.

5. The ballistic vest of claim 4 wherein the fastener is a zipper.

6. The ballistic vest of claim 4 wherein the fastener is hook and loop straps.

7. The ballistic vest of claim 1 wherein the front panel is attached to the ballistic duty gear component by an elastic strap.

8. The ballistic vest of claim 7 wherein the elastic strap has a buckle.

9. The ballistic vest of claim 1 wherein the ballistic vest component includes an outer carrier formed as a uniform shirt.

10. A combination body armor and duty gear support comprising:

a ballistic vest having a front panel and a rear panel; and a single piece duty gear portion having a ballistic package extending entirely around the waist of a wearer removably attached to the ballistic vest, the duty gear portion further having a duty gear belt;

wherein the ballistic vest at least partially overlaps the duty gear portion.

11. The combination of claim 10 wherein the duty gear belt is positioned on an outer surface of the duty gear portion.

12. The combination of claim 10 wherein the duty gear belt integrally is formed into the duty gear portion.

13. The combination of claim 10 wherein the ballistic vest and the duty gear portion are connected such that weight from a plurality of duty gear items is supported by both the ballistic vest and the duty gear portion.

14. The combination of claim 10 wherein the rear panel of the ballistic vest is attached to the duty gear portion by a fastener.

15. The combination of claim 10 wherein the front panel of the ballistic vest is attached to the duty gear portion by at least one elastic strap and buckle.

16. A ballistic vest comprising:

a front panel;

a back panel; and a single piece waist panel rigidly connected to the rear panel and overlappingly connected to the front panel for supporting a plurality of law enforcement duty gear articles.

17. The ballistic vest of claim 16 wherein the waist panel includes a duty gear belt.

18. The ballistic vest of claim 6 wherein the waist panel includes raised side portions for providing ballistic protection for each side of a wearer.

* * * * *